United States Patent [19]

Gidlund et al.

[11] Patent Number: 4,676,422

[45] Date of Patent: Jun. 30, 1987

[54] RIVETING DEVICE

[75] Inventors: Per A. L. Gidlund, Täby; John A. L. Zamore, Upsala, both of Sweden

[73] Assignee: Atlas Copco Aktiebolag, Nacka, Sweden

[21] Appl. No.: 833,868

[22] Filed: Feb. 25, 1986

[30] Foreign Application Priority Data

Mar. 11, 1985 [SE] Sweden ..... 8501191

[51] Int. Cl.[4] ..... B21J 15/10

[52] U.S. Cl. ..... 227/51

[58] Field of Search ..... 227/7, 51, 60, 61, 62

[56] References Cited

U.S. PATENT DOCUMENTS 3,491,930 1/1970 Hill ..... 227/51 X 3,534,896 10/1970 Speller et al. ..... 227/51

3,536,316 10/1970 De Voss ..... 227/51 X

*Primary Examiner*—Paul A. Bell

*Attorney, Agent, or Firm*—Frishauf, Holtz, Goodman & Woodward

[57] ABSTRACT

A riveting device for the assemblage of two or more sheet metal sections (A, B) of a structure comprising a working unit (14) operable on one side of the sections (A, B) to be assembled and a clamping and bucking unit (26) operable one the opposite side of the sections. Both units (14, 26) comprise clamping means (16 and 31, 62, 72) respectively, by which the sections (A, B) are clamped together during the entire working cycle in each rivet position, i.e. during hole making, seal compound application, rivet insertion and rivet upsetting. The clamping means of the bucking unit (26) comprises a head (62; 90), one or more low inertia contact elements (72; 94) and a resilient impact absorbing means (66; 101, 102) provided between the contact element or elements (72; 94) and the head (62; 90). The combination of a low inertia contact element and a resilient impact absorbing means provides a solution to the problem of reducing the extremely high contact forces generated at each blow from the riveting tool between the clamping means on the bucking side and the sheet metal sections (A, B). Deformation of the sections (A, B) due to such high forces is thereby avoided.

10 Claims, 7 Drawing Figures

RIVETING DEVICE

BACKGROUND OF THE INVENTION

This invention relates to a riveting device for the assemblage of two or more sheet metal sections of a structure.

In particular, the invention concerns a riveting device of the above type comprising a percussive riveting tool arranged to operate on one side of said sections, an inertia bucking means located on the opposite side of said sections and being applicable against the rivets being worked by said riveting tool, a first clamping means applicable against said sections on the same side as said riveting tool, a second clamping means applicable against said sections on the same side as said inertia bucking means, and a means for locating said riveting tool and said inertia bucking means as well as said first clamping means and said second clamping means in various working positions on the sections to be assembled.

A problem inherent in previous rivet bucking devices of the above type resides in the fact that the impacts delivered to the rivets by the percussive riveting tool are transferred also to the structure sections to be assembled and that these tend to be deformed in the area around each rivet. The reason is that the percussive riveting tool is arranged to direct its blows onto the head of the rivet, whereas the inertia bucking means is applied on the rivet shaft to be upset. This is to ensure that the rivet head is firmly seated against the sections to be assembled. If the tools were arranged the other way around it might occur that the rivet head would be slightly separated from the surface of the work piece as a direct result of the blows of the riveting hammer.

For each blow of the riveting hammer onto the rivet head the rivet and that part of the sheet metal sections that closely surrounds the rivet are displaced a distance corresponding to the rate of deformation of the rivet shaft accomplished at each blow. Thereat, the rivet and the sheet metal portion around the rivet are exposed to a very high acceleration in the direction toward the bucking means: This acceleration amounts to 10, 000–20, 000 $m/s^2$.

Since the clamping means of previous riveting devices possess a considerable, inertial mass, the acceleration of that part of the sheet metal sections that is backed by the clamping means is counteracted by a force great enough to deform the sheet metal sections. This results in an uneven section joint, which is most undesirable, especially in air craft assembling where the demands for even surfaces are high.

The main object of the invention is to provide an improved riveting device of the above type in which the clamping means arranged on the rivet bucking side of the sections to be assembled has such inertial properties that an undesirable deformation of the structure sections is avoided.

This is accomplished by the characteristic feature of the invention recited in the claims.

Further objects and advantages of the invention will appear from the following description and claims.

Embodiments of the invention are hereinbelow described in detail under reference to the accompanying drawings.

BRIEF DESCRIPTION OF THE DRAWINGS

FIGl. 1 shows a riveting device according to the invention in an air craft fuselage assembling application.

DETAILED DESCRIPTION

Figure 1:
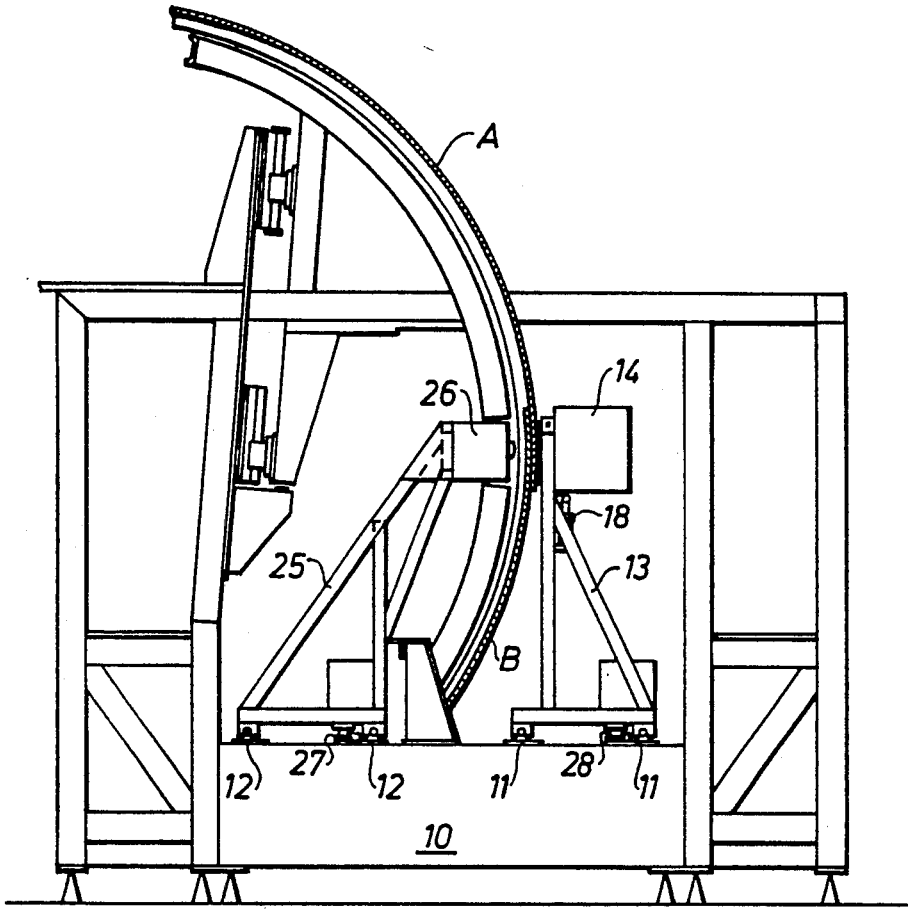
Figure 2:
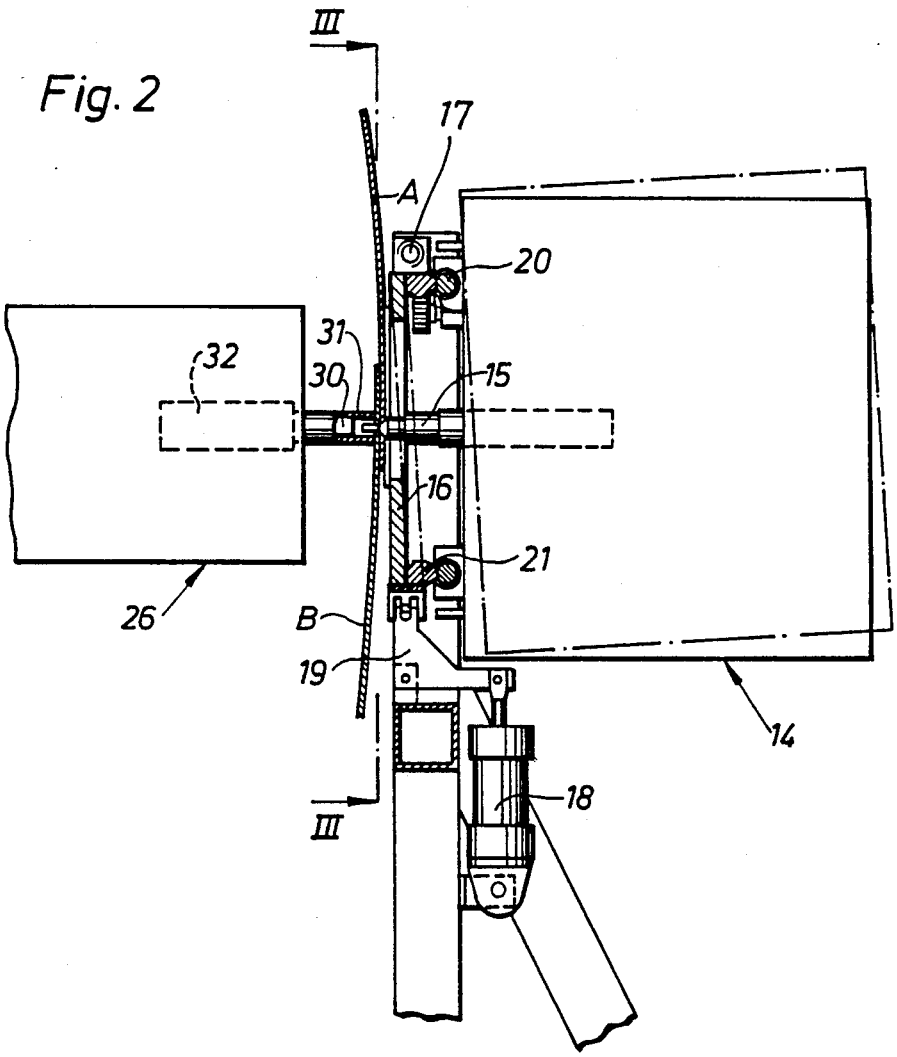
FIG. 2 shows on a larger scale and partly in section a fragmentary side view of the device in FIG. 1.

In FIG. 1 the riveting device according to the invention is shown in an application where two air craft fuselage panels A, B of sheet metal together with crack stopper plates, ribs etc. are assembled. These panels A, B are fixed relative to each other in predetermined positions by a stationary jig 10. The latter comprises two parallel tracks 11, 12 which also extend in parallel with the panels or sections A, B. On one of these tracks 11 there is displaceably guided a support carriage 13 on which a working unit 14 is mounted. The latter includes a hole drilling and counterboring means, a rivet inserting means, a seal compound applicator and a percussive riveting tool 15. Only the latter is shown in FIG. 2. On the support carriage 13 there is also mounted a thrust plate 16. The latter is movably supported by a pivot 17 and arranged to be shifted between a work piece clamping position (as shown in FIG. 2) and a rest or transport position. The shifting motion is accpmplished by a pneumatic cylinder 18 and a L-shaped rocker 19.

Figure 3:
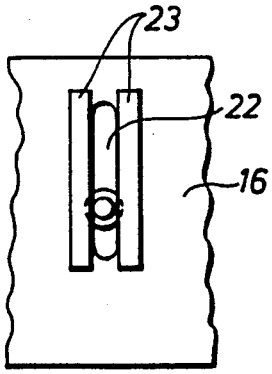
FIG. 3 is an end view of the riveting tool.

The thrust plate 16 comprises to parallel guide rails 20, 21 on which the working unit 14 is movable in order to selectively align its hole drilling and counterboring means, rivet inserting means, seal compund applicator and riveting tool with the actual riveting position. The thrust plate 16 is formed with a vertical slot 22 (see FIG. 3) through which the working means of the unit 14 have access to the work piece. Adjacent the slot 22 the thrust plate 16 is provided with two resilient contact pads 23 by which a thrust or clamping force is transferred to the sheet metal sections to be assembled.

The working unit 14 also comprises a subunit (not shown) which is the actual carrier of all of the working means and which is movably guided in a vertical plane, i.e. perpendicularly to the guide rails 20, 21. This movable subunit makes it possible for the working means of the working unit 14 to reach riveting positions vertically spaced from each other but confined within the slot 22 of the thrust plate 16. Since the features of the working unit in this respect do not constitute any part of the invention a detailed description thereof is left out from this specification.

On the other 12 of the two parallel tracks on the jig 10 there is movably guided another support carriage 25 on which is mounted a clamping and rivet bucking unit 26. This support carriage 25 is stepwise movable along the track 12 in unison with the support carriage 13 running on the other track 11 such that the working means of the working unit 14 and the clamping and rivet bucking unit 26 are always working in the very same position on the sections A, B to be assembled. The two support carriages 13, 25 are propelled along the tracks 11 and 12, respectively, by means of rack and pinion drives 26 and 27, respectively. The movement of the carriages 13, 25 as well as the operation cycles of the working unit 14 and the clamping and rivet bucking unit 26 are governed by a computerized control system of any well known type which is not described in detail in this application.

The clamping and rivet bucking unit 26 comprises an inertia member in the form of a rod 30, a clamping means in the form of a tube 31 closely surrounding the rod 30 and a piston-cylinder device 32 for activating the unit in response to the operation of the working unit 14 on the opposite side of the sections to be assembled. See FIG. 2 and 4.

The rod 30 which has a big inertial mass is provided with a thread 33 at its forward end for attachement of a rivet engaging die. The tube 31 has a reduced diameter front end 34 on which a clamping head is attachable. At its rear end the tube 31 is provided with a piston 35 having two axially spaced sealing portions 36, 37 which are both guided in a main cylinder 39 and defining an annular space 38. At its rear end the piston 35 is provided with a damping piston 40 which is sealingly received in the main air supply opening 41 in the rear end wall 42 of the cylinder 39 as the piston 35 occupies its rear end position. A restricted bypass passage 43 is arranged to lead pressure air to and from the cylinder 39 as the main air supply opening 41 is blocked.

An auxiliary cylinder 45 of smaller diameter is formed by a bore within the piston 35. A piston 46 mounted on the rear end of the inertia rod 30 is sealingly guided in the cylinder 45 and arranged to shift the inertia rod 30 relative to the tube 31 from a retracted rest position in which it abuts against a shoulder 47 on the damping piston 40 to an advanced active position determined by an opposite shoulder 48 in the cylinder 45. A spring 50 is employed under piston 46 to bias the latter and the inertia rod 30 toward the rear rest position, and a seal ring 55 is mounted on piston 46 to seal off the cylinder bore 45.

In the end walls 43, 51 of the main cylinder 39 there are provided air communication ports 44 and 49, respectively, and by a selective pressure air supply to these ports the clamping tube 31 and the inertia rod 30 are movable together between a retracted position, which may be referred to as a primary rest or transport position, (shown in FIG. 4) and an advanced position. In the primary rest position the clamping tube 31 and the inertia rod 30 are fully retracted which makes it possible to move the bucking unit 26 past ribs and other reinforcement elements on the sections A, B to be assembled.

In the forward end wall 51 of the cylinder 39 there is an annular cylinder chamber 52 in which is sealingly guided a ring piston 53. The latter is coaxial with rod 30 and comprises an axial collar 54 which is arranged to form a movement limiting means for piston 35.

Figure 4:
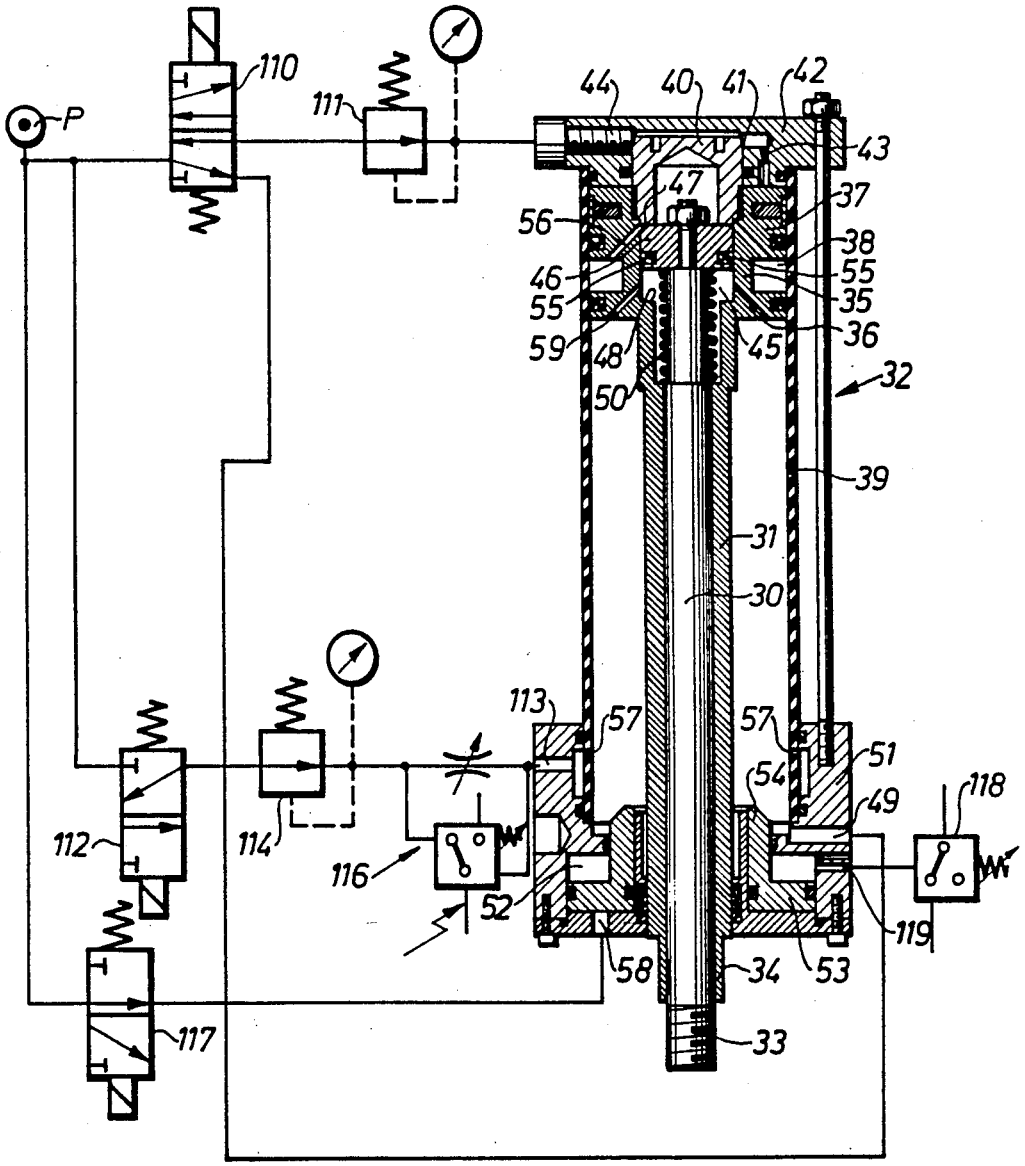
FIG. 4 shows a longitudinal section through the clamping and rivet bucking device and a schematic illustration of its control system.

In its lower position, as shown in FIG. 4, the piston 53 is in a position which allows the piston 35 together with the tube 31 and the inertia rod 30 to occupy their most extended active positions where the inertia rod 30 by means of an attached die is applied against a rivet to be worked and where the tube 31 by means of a clamping head is urged against the sections to be assembled. When shifted to its upper position the ring piston 53 lifts the tube 31 and the inertia rod 30 to a secondary rest or transport position in which the bucking unit 26 is intended to be moved from one riveting position to another adjacent position where no ribs or other reinforcement elements have to be passed. The uplifted or upper position of the ring piston 53 is obtained by supply of pressure air to the lower part of cylinder chamber 52 via an inlet port 58. A return movement of piston 53 to its lower position (shown in FIG. 4) is accomplished by depressurizing chamber 52, whereby the actuating pressure acting upon the piston 35 will be effective to force the piston 53 back to its lower position.

The piston 35 is provided with a passage 56 through which pressure air is communicated between the annular space 38 and the cylinder bore 45 in order to pressurize the latter and shift the inertia rod 30 to its forward active position. The annular space 38 of the piston 35 is supplied with pressure air via ports 57 in the cylinder 39. This means that the cylinder bore 45 may be pressurized only when the main piston 35 occupies its forwardmost position in the cylinder 39 where the annular space 38 registers with the ports 57.

Furthermore, the piston 35 is provided with a pressure relief passage 59 which extends from the lower end surface of piston 35 to the cylinder bore 45. The passage 59 ends in the cylinder bore 45 at a certain distance from the shoulder 48 in the latter such that when the piston 45 and the inertia rods 30 is moved to their extreme forward positions, i.e. when piston 46 abuts shoulder 48, the seal ring 55 is moved past the passage 59, whereby communication between passage 56 and passage 59 is established. This means that pressure air supplied through passage 56 to move the inertia rod 30 to its active rivet bucking position leaks out through passage 59. This occurs only when no rivet is inserted and the inertia rod 30 via its die has no rivet shaft to land on. This is a fault situation and the air flow established through the cylinder bore 45 is used for accomplishing a signal indicating a missing rivet as described below.

By means of the thread 33 on the forward end of the inertia rod 30 there is attached a rivet engaging die. In the embodiment shown in FIG. 5 the inertia rod 30 is provided with a cylindrical die 61. According to the embodiment shown in FIG. 5 a head 62 is firmly clamped to the forward end portion 34 of the tube 31 by means of two screws 63, 64. The head 62 is formed with an annular recess 65 at its front end, in which recess 65 there are located two Belleville springs 66 and the rear end of a socket sleeve 67. The latter is axially framed by on one side the Belleville springs 66 and on the other side by a lock ring 68 mounted in the recess 65. The sleeve 67 is locked against rotation by having an axial slot 70 in which a radial pin 69 extends. In the socket sleeve 67 there is received a tubular contact element 72 made from a light material such as plastics. The contact element 72 has two oppositely located apertures 73 and two passages 74, 75 through which pressure air for clean blowing purposes is directed to the rivet being worked. These passages 74, 75 communicate with an air chamber 76 within the head 62 which is sealed off by means of two axially spaced seal rings 77, 78. The air chamber 76 is supplied with pressure air through a lateral opening 80 in the head 62.

Figure 5:
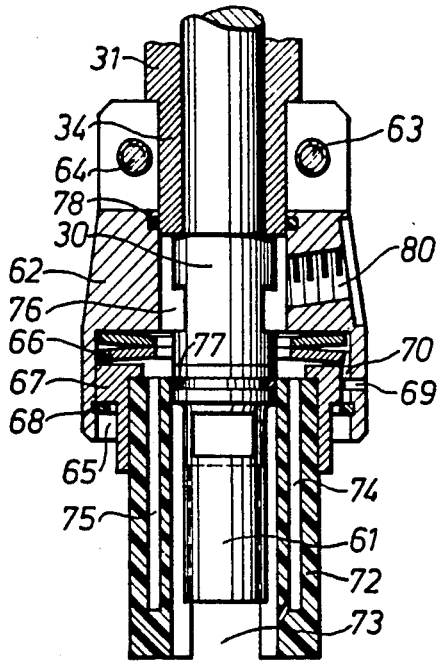
FIG. 5 shows a longitudinal section through the head and the work piece abutting elements of the clamping means.

The contact element 72 shown in FIG. 5 is applied against the surface of the sections A,B to be assembled in axial alignment with a rivet hole. The bucking die 61 is in its rest position waiting for a rivet to be inserted in the hole in the sections A, B. The auxiliary piston 46 connected to the inertia rod 30 is not actuated.

Figure 6:
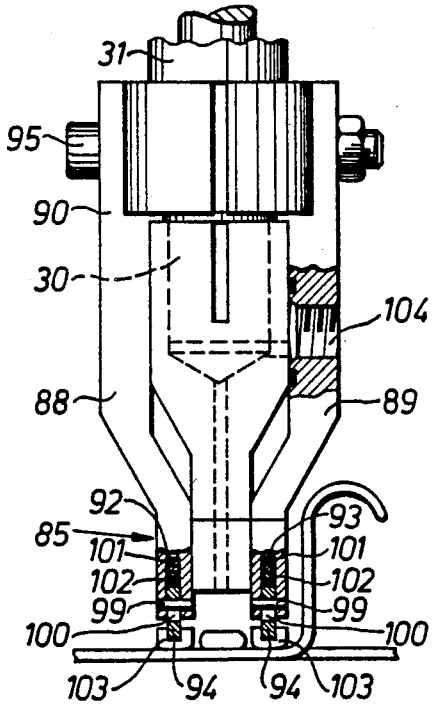
FIG. 6 shows an end view of an alternative embodiment of the head and the work piece abutting elements.
Figure 7:
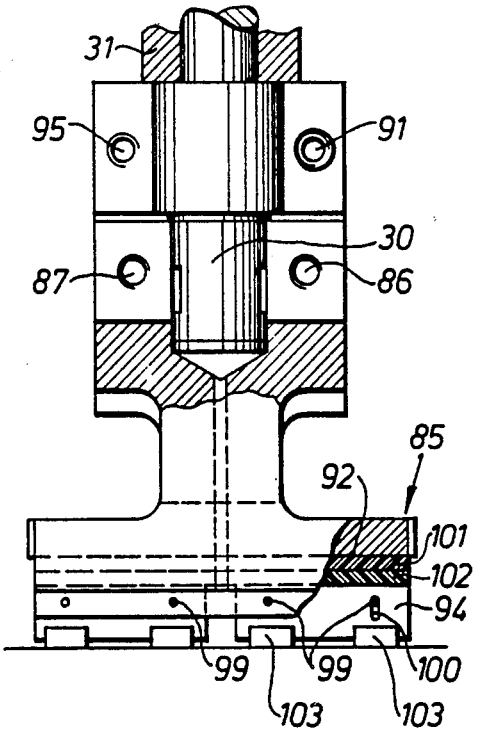
FIG. 7 shows a side view of the device in FIG. 6.

In FIGS. 6 and 7 there is shown another embodiment of the invention according to which a T-shaped die 85 is fitted to the front end of the inertia rod 30. Instead of using the thread 33 on the rod 30 a clamp joint comprising two screws 86, 87 is used. On both sides of the die 85 there are T-shaped legs 88, 89 of a head 90 mounted on the tube 31 by means of a clamp joint including two screws 92, 93. At the lower end of these legs 88, 89 there are longitudinal slots 92 and 93, respectively, in each of which are mounted two contact elements 94. Pins 99 extending transversely across the slots 92, 93 serves to retain the contact elements 94. The latters have oval openings 100 through which the pins 99 extend and by which a certain movability of the contact elements 94 is obtained. In each of the slots 92, 93, behind the contact elements 94, there are mounted two resilient ribs 101, 102. These ribs 101, 102, which are made of rubber or a material with similar elastic properties, form spring means by which the contact elements 94 are insulated relative to the legs 88, 89, the head 90, the tube 31 and the piston 35 as regards transmission of mechanical shock waves. The contact elements 94 may be of a metallic or non-metallic material and are preferably provided with wear resistant shoes 103. An air passage for clean blowing purpose extends through the die 85 and communicates with a pressure air inlet 104 on one of the legs 89.

The control system by which the riveting device is governed includes a pneumatic system connected to the rivet bucking and clamping unit 26. This pneumatic system comprises a pressure air source P to which is connected a directional valve 110. By the latter the main cylinder 39 via ports 44, 49 is supplied and drained with air to move by means of piston 35 the tube 31 and the inertia rod 30 between their retracted primary rest positions and their advanced operative or secondary rest positions. A pressure regulator 111 is incorporated between the valve 110 and the port 44 providing the possibility to vary the pressure behind the main piston 35 and, thereby, vary the thrust force applied on the sections A, B.

A second directional valve 112 is connected to the pressure air source P and controls the air supply to the ports 57 in the main cylinder 39 via a communication opening 113 in the latter. Between the valve 112 and the cylinder 39 there is fitted a pressure regulator 114 and a flow sensitive signal producing device 116. By varying the setting of pressure regulator 114 it is possible to change the bucking force of the rod 30 against the rivet shafts. If no rivet is inserted the rod 30 is advanced far enough to make supplied pressure air leak past the seal 55 of piston 46 and out through passage 59. In such case the leak flow is detected by the flow sensitive signal producing device 116 and a signal is generated indicating of the situation.

A third directional valve 117 is connected to the pressure air source P to direct pressure air to and from the communication port 55 of the cylinder chamber 52 in order to move the ring piston 53 between its lower rest position and its uplifted active position. A pressure sensitive signal producing device 118 is connected to the cylinder chamber 53 via a port 119 to indicated the uplifted active position of the ring piston 52.

We claim:

1. A riveting device for assembling at least two sheet metal sections (A,B) of a structure, comprising:

a percussive riveting tool (15) arranged to operate on one side of said sheet metal sections;

an inertia rivet bucking means (30, 61; 85) located on the opposite side of said sheet metal sections and being applicable against rivets being worked by said riveting tool (15);

first clamping means (16) applicable against said sheet metal sections on the same side as said riveting tool (15);

second clamping means (31, 62; 88) applicable against said sheet metal sections on the same side as said inertia rivet backing means (30, 61; 85); and control means for locating said riveting tool (15) and said inertia rivet bucking means (30, 61; 85) as well as said first clamping means (16) and said second clamping means (31, 62; 88) in various working positions on said sheet metal sections of said structure;

said second clamping means (31, 62; 88) comprising:

a head (62; 88);

at least one low inertai contact element (72; 94) carried by said head (62; 88) and arranged to be applied against said sheet metal sections of said structure; and an impact absorbing means (66; 101, 102) provided between each of said at least one contact element (72; 94) and said head (62; 88).

2. The riveting device of claim 1, wherein said at least one low inertia contact element (72) comprises a non-metallic sleeve symmetrically surrounding said inertia rivet bucking means (30, 6i) and being arranged to be applied against said sheet metal sections in a symmetrical disposition relative to a rivet being worked.

3. The riveting device of claim 2, wherein said impact absorbing means (66) comprises at least one spring element.

4. The riveting device of claim 3, wherein said at least one spring element (66) comprises a Belleville-type washer spring.

5. The riveting device of claim 1, wherein:

each of said at least one low inertia contact element (94) comprises substantially straight ribs supported in two substantially parallel slots (92, 93) in said head (88) and arranged to be applied against said sheet metal sections on opposite sides of a river being worked; and said impact absorbing means comprises at least one resilient buffer element (101, 102) disposed in each of said slots (92, 93) behind said ribs (94).

6. The riveting device of claim 2, wherein said inertia rivet bucking means (30, 61; 85) comprises a rod element (30) which is arranged to be axially aligned with a rivet being worked, said head (62) surrounding at least partly said rod element (30).

7. The riveting device of claim 2, wherein said second clamping means (31, 62; 88) further comprises a tube element (31) which surround said rod element (30) of said inertia rivet bucking means (30, 61) and forms a radial support for said inertia rivet bucking means.

8. The riveting device of any one of claims 1–7, further comprising:

first actuating means (45, 46) coupled to said inertia rivet bucking means (30, 61; 85) to move said inertia rivet bucking means between an advanced active position and an inactive position; and second actuating means (35, 39) coupled to said second clamping means (31, 62; 88) to move said second clamping means between an advanced clamping position and a retracted inactive position;

said first actuating means (45, 46) being associated and displaceable together with said second clamping means (31, 62; 88).

9. The riveting device of claim 8, wherein both said first actuating means (45, 46) and said second actuating means (35, 39) comprise pressure fluid operated piston-cylinder devices, the cylinder (45) of said first actuating means (45, 46) being coupled with the piston (35) of said second actuating means (35, 39).

10. The riveting device of claim 9, wherein said cylinder (45) of said first actuating means (45, 46) is formed in said piston (35) of said second actuating means (35, 39).

* * * * *

UNITED STATES PATENT AND TRADEMARK OFFICE

CERTIFICATE OF CORRECTION

PATENT NO. : 4,676,422

DATED : June 30, 1987

INVENTOR(S) : GIDLUND et al

It is certified that error appears in the above-identified patent and that said Letters Patent is hereby corrected as shown below:

Column 6, line 17, "inertai" should read -- inertia --

Column 6, line 27 (claim 2, line 4), "(30,6i)" should read -- (30,61) --

Column 6, line 41 (claim 5, line 6), "river" should read -- rivet --.

Signed and Sealed this

Twenty-second Day of November, 1988

*Attest:*

DONALD J. QUIGG

*Attesting Officer*

*Commissioner of Patents and Trademarks*